United States Patent [19]

Lechner et al.

[11] Patent Number: 4,603,457

[45] Date of Patent: Aug. 5, 1986

[54] METHOD AND DEVICE FOR MAKING A WRAPPED JOINT

[75] Inventors: Ernst F. Lechner, Erlangen; Peter Vache, Heroldsbach, both of Fed. Rep. of Germany

[73] Assignee: Siemens Aktiengesellschaft, Berlin and Munich, Fed. Rep. of Germany

[21] Appl. No.: 407,595

[22] Filed: Aug. 12, 1982

[30] Foreign Application Priority Data

Aug. 12, 1981 [DE] Fed. Rep. of Germany ..... 31319549

[51] Int. Cl.[4] ..... H01R 43/00

[52] U.S. Cl. ..... 29/33 F; 29/566.4; 29/751; 140/124; 242/7.17

[58] Field of Search ..... 29/33 F, 33 M, 566.4, 29/751; 242/7.17, 7.18; 140/124, 123.5; 7/158

[56] References Cited

U.S. PATENT DOCUMENTS

| | | | |
|---|---|---|---|
| 2,746,124 | 5/1956 | Belek | 29/33 F |
| 2,758,797 | 8/1956 | Miklan | 29/33 F X |
| 2,793,419 | 5/1957 | Larsen | 29/33 F |
| 3,378,906 | 4/1968 | Dorsey | 29/751 |

*Primary Examiner*—Z. R. Bilinsky

*Attorney, Agent, or Firm*—Herbert L. Lerner; Laurence A. Greenberg

[57] ABSTRACT

In wrapping a wire around a pin, the turn being produced is rolled against the pin by a tool surface (21) which rotates with the wrapping motion, so that defined and reproducible contact areas are created. As far as the forces are concerned, the contact-making and wrapping are decoupled from each other; the tension of the wire therefore needs to be designed only still for the wrapping process proper.

11 Claims, 16 Drawing Figures

METHOD AND DEVICE FOR MAKING A WRAPPED JOINT

The present invention relates to a method for making an electrically conducting wrapped joint between a, particularly insulation-jacketed, wire and a metallic pin. Such a method is described, for instance, in the journal "Electrotechnik",no.½, 1981, pages 33 to 34 and is called there "wire-wrap technique". There, a solid wire is wrapped under tension around a rectangular post. Under the influence of the tension, the wire is elongated and is deformed at the four corners of the pin, whereby the contact area required for making contact between the wire and the pin is created. With the conventional wire-wrap technique, the radial force required for making contact is derived exclusively from the tension with which the wire is wrapped around the pin and is therefore limited by the tensile strength of the wire material. As a result, a relatively large number of wire turns was necessary to obtain a sufficiently low contact resistance between the pin and the wire and to ensure sufficient adhesion of the wrapped joint on the pin. In addition, making contact with insulation-jacketed wire was possible at all only with relatively little-resistant insulation or if the insulation jacket was first removed by special cutting devices or notched or slit open at the points provided for making contact; then, the sharpness of the cutting edges or knives had to be monitored continuously in order to ensure ubiform contact throughout. In the known method, finally, the contact quality was dependent on the contact pressure of the tool, whereby contacts of rather different quality are obtained, especially if the wrapping tool is operated by hand. While the adverse effects of this influence can be partly reduced by the provision that still more turns of wire are applied per wrapped joint, the material, time and labor costs are increased thereby.

All these shortcomings make the present wrapping methods appear rather inefficient. It is therefore an object of the present invention to describe a simple method, with which a defined, i.e., always reproducible contact area can be ensured independently of the tension, the contact pressure of the wrapping tool and the material properties of the wire and the pin, and this for bare solid wire as well as for insulation-jacketed wire, the insulation of which is neither to be removed nor slit up nor notched prior to the wrapping process. This makes the work more efficient and a better and more uniform contact can be obtained with a minimum number of turns and, if insulation-jacketed wire is used, the insulation is preserved at the not contacted points.

According to the invention, this problem is solved by the provision that radial forces are brought to bear during the wrapping, maintaining close contact along the entire outer circumference of the wrap. It is therefore the basic idea of the invention to arrange the wrapping and the contact-making so that they can be decoupled force-wise inasmuch as the force required for obtaining the electrical contact is not supplied by the tension but by a separate tool which is rotated with the wrapping motion and is brought into direct contact with the wire, whereby the deformation energy required for making contact is taken directly from the tool drive and tension of only such magnitude is still required as is needed for the pure wrapping process.

One embodiment of the method according to the invention consists in that radially effective forces are brought to bear simultaneously at least at two opposite points of the individual turns. Thereby, a giving-way motion of the pin can be counteracted.

A further embodiment of the method according to the invention consists in the provision that the individual turns are rolled against the pin by means of at least one tool surface rotating with the wrapping motion. Thereby, the deformation required for making contact or cold-welding between the pin and the wire takes place not suddenly but gradually, similar to the rolling of material which is moved through a gradually decreasing roll opening.

The present invention further relates to a device for making an electrically conducting wrapped joint of the type mentioned at the outset with a rotating wrapping insert which guides the wire to be wrapped in a continuous lengthwise canal, receives the pin in a central bore hole and is inserted into a stationary guidance sleeve, and has the objective to make this device practical in the simplest manner for carrying out the method according to the invention. According to the invention, this is accomplished by the provision that the end face of the wrapping insert facing the pin has a transverse slot into which the longitudinal canal opens and which expands, at least sectionwise, toward the slot bottom, the depth of the transverse slot being larger than the diameter of the wire or the jacket. It is the basic idea of this embodiment to grip the individual turn as it is produced between the pin and the flanks of the transverse slot and have the flanks of the transverse slot exert the required contact pressure during the rotation of the wrapping insert.

The invention together with its further embodiments, which are characterized in subclaims, will be illustrated in further detail in the following, making reference to the figures.

BRIEF DESCRIPTION OF THE DRAWINGS:

FIG.1 first shows the principle of the wrapping method according to the state of the art mentioned at the outset. A wire 1 is guided around the center Z on a revolving track 2 and is wrapped in the process around a stationary pin 3 with the tension P. As the wire 1 guided on a circular track is looped around the corners of the pin, the radial component of the tension P directed toward the center Z supplied the required contact pressure which has its smallest value at the corner shown at the top left in FIG. 1 when the wire starts to touch this corner and has its largest value when the wire 1 touches the next-following corner. The wire 1 is stretched during the wrapping and is deformed at the corners so that the latter make notches into the wire and thereby provide a contact area. It is essential that contact points are formed only in the vicinity of the corners and that the deformation energy can be supplied only by the tension P.

FIG. 2 shows the principle for the wrapping method according to the invention, wherein the same instantaneous position of the end of the wire 1 is shown. Concentrically and in the same sense with the wire guide rotates a surface desiganted with F at a distance R from the center Z, which is constantly in positive contact with the turn of the wrapping just being made. The instantaneous end coming from the wire guide is taken between the pin 3 and the surface F and is squeezed or rolled by the surface F through the gap which is locally narrowed upon further rotation against the pin 3, until finally the completed wrapping has the radius R which corresponds to the distance of the surface F from the center Z. This makes possible intimate contact (cold welding) with the wire 1 not only at the corners of the pin but, with proper choice of the radial distance R, also at the entire circumference of the pin, where the respective radial force $K_r$ required therefore does not have to be supplied by the tension P and therefore with a corresponding tensile stress of the wire 1, but by the rotating surface F and thus, by the driving torque of the wrapping tool. The tension P can accordingly be held very small, since it no longer needs to supply the component required for making contact as in the method according to FIG. 1. The tension P, of course, could be increased further for aiding the deformation due to the rolling-on over and above the amount required for the wrapping process alone. In the method according to the invention, the advantage is also substantial that the final dimensions of the finished wrap and thereby, the depth of penetration of the pin or the size of the contact area can be fixed unambiguously and reproducibly by the distance R of the surface F from the center Z, which can be chosen freely within wide limits. The wrapping method according to the invention thereby permits also making contact with pins of any desired, for instance, hexagonal or even circular cross section.

To avoid a one-sided stress on the pin, especially to prevent the pin from giving way if the latter is not held without play, it may be practical to arrange symmetrically to the surface F, i.e., parallel and at the same distance from the center Z, a second surface F' which co-rotates in the same sense, whereby then an oppositely-directed radial force $K_r'$ can be brought to bear on the wrapping or the pin 3, which cancels the effect of the radial force $K_r$ on the pin.

Figure 3:
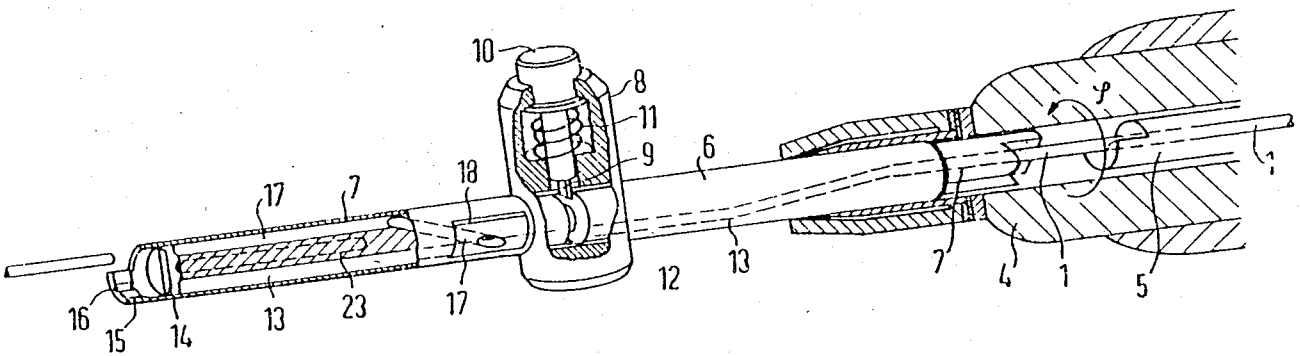
FIG. 3 is a longitudinal sectional view of a device for performing the method according to the invention.

FIG. 3 shows an overall view of a device suitable for carrying out the method according to the invention. With 4 is designated the front end of a driving tool, the shaft 5 of which is driven by an electric motor and can be connected via an engageable clutch, not shown in detail, to a wrapping insert 6. The wrapping insert is supported in a stationary guide sleeve 7 on which an adapter 8 is placed in which a knife blade 9 is supported which can be put in a circular slot 12 provided in the adapter 6 against the force of a spring 11 upon pressure on a button 10 protruding from the adapter 8. Thereby, a wire 1 which can be inserted from the rear through a corresponding hole in the shaft 5 and a wire-guide canal 13 which follows thereon and extends in the wrapping insert 6, can be cut off by operating the pushbutton 10 and rotating the shaft 5 or the insert 6 connected thereto. The knife can also be provided with cutting edges on both sides, so that the wire can be cut off not only with the indicated direction of rotation $\phi$ but also with the opposite direction of rotation of the shaft 5.

The longitudinal canal 13 which initially extends in the axis of rotation, is continued in the insert 6 in the vicinity of the circumference and ends in a transverse slot 14. The flanks of this transverse slot form the tool surfaces, as will be shown in detail later on, which effect, in close contact with the wrapping, the deformation of the wire. The guide sleeve 7 has at its end a finger-shaped extension 15 with a guiding channel 16 for fixing the wire 1 which can be inserted from the rear. The insert 6 has a further wire-guiding canal 16 which starts at the bottom of the transversible slot 14 and ends at a cutting window 17 of the guide-sleeve 7. The wire-guiding canal 15 may be provided if the wire to be wrapped is to be inserted from the front instead of from the rear. The wrapping insert 6 or the clutch connecting it to the shaft 5 is designed with a detent in a manner known per se, so that for every stop of the wrapping insert 6, the end of the wire guiding canal 16 comes to lie under the cutting-off window 17 and can be cut to length with each new start.

Figure 4:
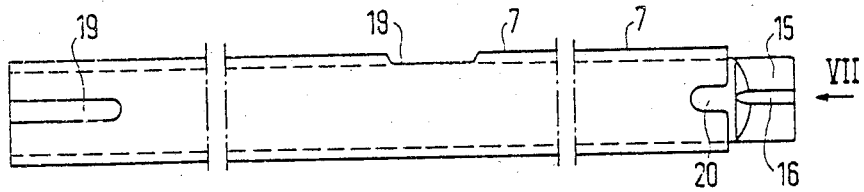
FIG. 4 is an enlarged fragmentary elevational view of FIG. 3 showing the wire guiding channel thereof together with a guide sleeve.

The guide sleeve 7 shown in FIG. 4 has at its end associated with the driving tool a recess 19, with which a fixed part of the driving tool engages and secures it against rotation. A further recess 20 serves for holding a wire which can be inserted from the front, while this is accomplished by the finger-shaped extension 15 if the wire 1 is inserted from the rear and is guided in the canal 13.

Figure 5:
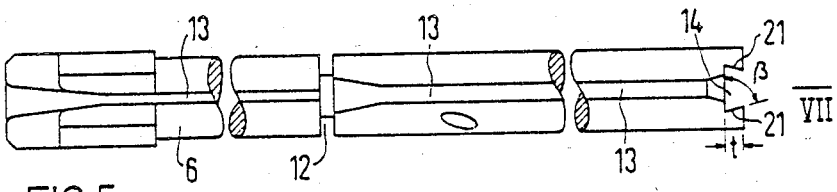
FIG. 5 is an enlarged fragmentary elevational view of FIG. 3 showing a wrapping insert thereof.
Figure 6:
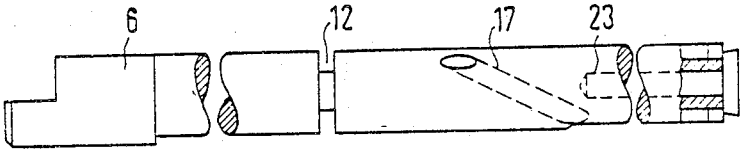
FIG. 6 is a view of the wrapping insert of FIG. 5 rotated through 90° about the longitudinal axis thereof.

FIGS. 5 and 6 show in detail the wrapping insert 6 in two views rotated 90°. In FIG. 5 is seen the continuous longitudinal canal 13 which ends at the front end of the wrapping insert in a slot 14 arranged transversely to the longitudinal axis. The flanks 21 of this symmetrically shaped transverse slot 14 do not extend perpendicularly to the bottom of the slot but are inclined thereto by an angle $\beta$, where the angle $\beta$ may move in a range between 60° and 89°. With t is designated the depth of the transverse slot 14, which is advantageously chosen larger than the diameter D of the wire to be wrapped or the diameter of its jacket if the wire is insulated ($t > D$), so that at least half a turn is contained in the transverse slot 14 and thereby, radially-acting forces are brought to bear on the wrapping with positive contact at mutually opposite points. The symmetrical design of the transverse slot further permits to apply wrappings with clockwise as well as counterclockwise rotation of the wrapping insert. With 22 is designated the exit opening of the wire-guiding canal 17 for wire insertion from the end face. The central hole 23 serves for receiving the pin 3 and has a diameter which is only slightly larger than the diagonal of a pin of rectangular cross section.

Figure 7:
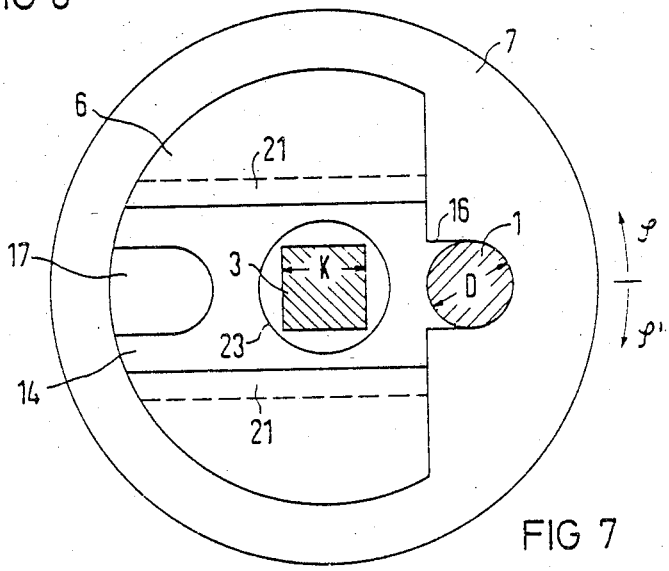
FIG. 7 is a much enlarged right-hand view of FIG. 4 as seen in the direction of the arrow VII.

FIG. 7 shows a view in the direction indicated in FIGS. 4 and 5 with VII, with the wrapping insert 6 placed in the guide sleeve 7. In FIG. 7, a square pin 3 with the side dimension K, contained in the central hole 23 is shown and it can further be seen how a wire 1 inserted from the rear is fixed in the guide channel 16 of the finger-shaped extension 15 of the guide sleeve 7. With the symmetrical shape of the transverse slot 14, radial forces simultaneously aimed in opposite direction can be exerted by its flanks 21 on the wrapping in tight contact therewith, and wrappings can be applied with clockwise as well as counterclockwise rotation of the wrapping insert 6; this can be done as selected,with the wire insertable from the front or the rear. The variant of the wrapping tool according to the invention shown in FIGS. 4 to 7 can thus be employed extremely universally.

Figure 2:
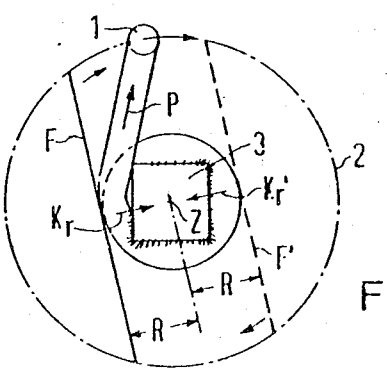
FIG. 2 is a view similar to that of FIG. 1 but illustrating the method of wrapping according to the invention.
Figure 1:
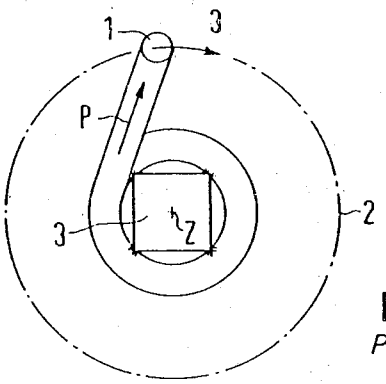
FIG 1 PRIOR ART
FIG. 1 is a diagrammatic end view of a stationary pin around which a wire is wrapped in accordance with the method of the prior art.
Figure 8:
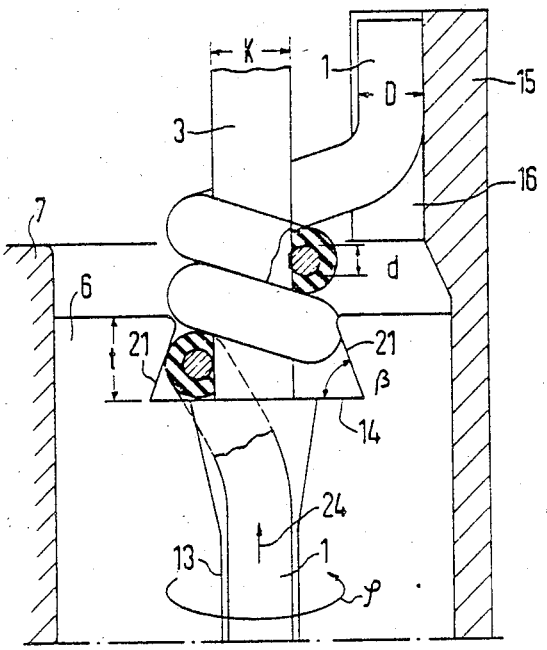
FIG. 8 is a diagrammatic elevational view, partly in section, of FIG. 7 illustrating the wrapping method of the invention.

FIG. 8 shows a cross-sectional view to illustrate the wrapping process according to the invention. The wire 1 inserted from the rear enters into the transverse slot 14 in the wire-guiding canal 13 in the direction of the arrow 24 and is gripped between its flank 21 and the pin 3. In the example shown, the dimensions of the transverse slot 14 are chosen so that in the radial direction, an inside width is available for the wire entering the bottom of the slot between the flank 21 and the pin 3, which corresponds approximately to the size $D/2+d$, where D is the diameter of the insulation jacket and d the diameter of the wire. If the wrapping insert 6 is rotated in the direction $\phi$ indicated, the wrapping insert 6 is screwed in the direction opposite the arrow 24 along the wrapping being produced, the wire 1 being gripped securely by the inclination of the slot flanks 21; it cannot give way under the radial forces acting thereon. Since the slot depth t is chosen larger than the diameter D of the wire 1, there is always more than half a turn within the transverse slot 14 and every point of the turn is rolled once against the pin 3 by each of the two slot flanks 21. As may be seen from the part of the wrapping which is already outside the slot and is shown in FIG. 8, a cold weld of the wire 1 with the sides of the pin 3 has been made thereby; as can also be seen from FIG. 2, such a cold weld will take place to an even larger extent, so that a very highly conducting joint and adhesion between the pin and the wire along the entire circumference of the pin can be achieved.

Figure 9:
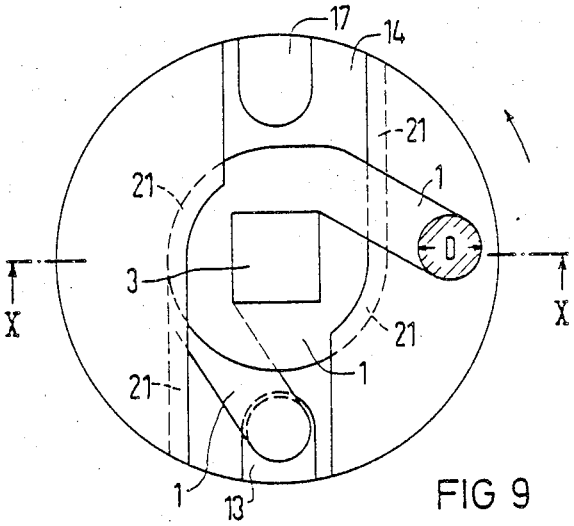
FIG. 9 is a fragmentary top plan view of FIG. 8 showing the transverse slot thereof.
Figure 10:
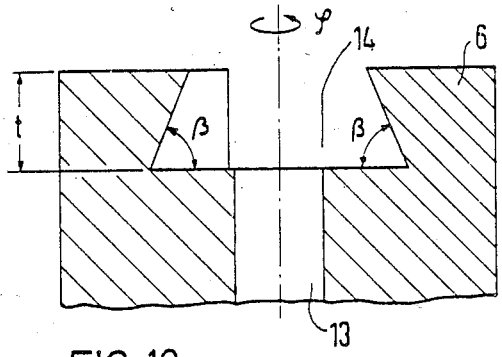
FIG. 10 is a cross-sectional view of FIG. 9 taken along the line X—X in direction of the arrows.

In FIGS. 9 and 10, a top view and a cross-sectional view of a transverse slot 14 of the winding insert 6 are shown, in which the flanks 21 which are again inclined against the bottom of the slot by the angle $\beta$, consist in part of a conical hole as opposed to the embodiment shown in FIGS. 5 to 7. As can be seen from the part of a wrapping of the wire 1 shown in FIG. 9, the wrapping to be made is thereby gripped by the flanks 21 of the transverse slot 14 over a larger part of its circumference, so that the pressing-on process can be more lasting and continuous. However, this embodiment of the transverse slot 14 is suitable only for the direction of rotation $\phi$.

By the slot depth t it is determined which part of a turn and what number of turns are instantaneously within the transverse slot 14 during the wrapping. Together with the widthof the transverse slot, the dimension k of the side of the pin and the angle of inclination $\beta$ of the slot flanks 21 as well as the speed of rotation of the wrapping insert 6, the extent and rate of deformation of the wire or its insulation can be determined and adapted to the respective situation. It was furthermore discovered that the inclination $\beta$ of the slot flanks 21 is important for secure seizing of the start of the turn between the slot flank 21 and the pin 3 at the start of the wrapping operation.

Figure 11:
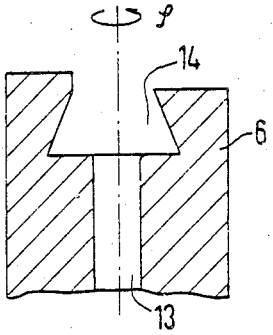
FIG. 11 is a view like that of FIG. 10 showing another construction of the transverse slot.

FIG. 11 shows another possible variant for the design of the transverse slot 14, in which a flank ends in a surface which is parallel to the longitudinal axis of the pin, which may turn out to be advantageous, depending on the material properties of the wire to be wrapped or its insulation. This embodiment of the transverse slot is preferably provided for the direction of rotation of the wrapping insert 6 designated by the rotation arrow $\phi$.

Figure 12:
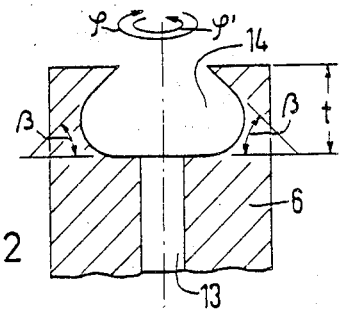
FIG. 12 is a view like that of ig. 11 showing a third construction of the transverse slot.

In the variant of FIG. 12, the flanks 21 of the transverse slot 14 are concave and better fit the wire 1 to be wrapped at the slot bottom. At the slot aperture, the flanks 21 are again inclined against the slot bottom by tha angle $\beta$. This cross section shape is suitable for both directions of rotation of the wrapping insert 6.

Figure 13:
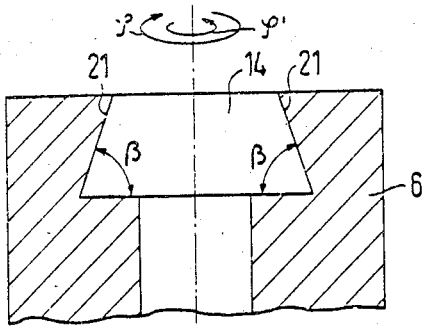
FIG. 13 is another view like that of FIG. 11 showing a fourth construction of the transverse slot.
Figure 14:
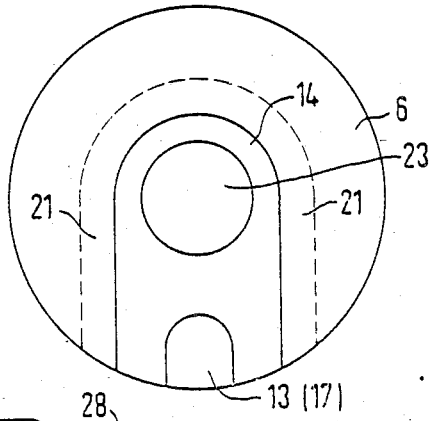
FIG. 14 is a top plan view of FIG. 13.

FIGS. 13 and 14, finally, show a variant of the design of the transverse slot, in which similarly to FIG. 9, the flanks of the transverse slot change into a conical hole which, however, extends now over a sector angle of 180°. Thereby, the wire 1 to be wrapped is gripped by the transverse slot along the longest possible path, maintaining positive contact, so that this design promises a particularly gentle but nevertheless very lasting deformation.

As already mentioned, it is within the state of the art, if the wire to be wrapped is introduced at the end face, to take care by a displaceable, detent clutch that when the electric drive is switched off, the end of the wire-guiding canal 17 always comes to a stop under a cutting-off window arranged in the guide sleeve 7. With the wrapping drives known for this purpose, the drive motor is switched-on for the duration of the manual operation of a pushbutton switch and at the same time, the clutch is engaged via a linkage mechanically connected to the pushbutton switch. Thus, always full turns, having a sector angle of 360°, are applied, the number of these turns depending on the duration of the actuation of the pushbutton switch. It now appears advisable, especially in a method according to the invention, with which in principle a uniformly good wrapped joint can be obtained with a minimum of turns, not to leave the setting of this number of turns to a person, but to provide for an automatic limitation of the number of turns.

Figure 15:
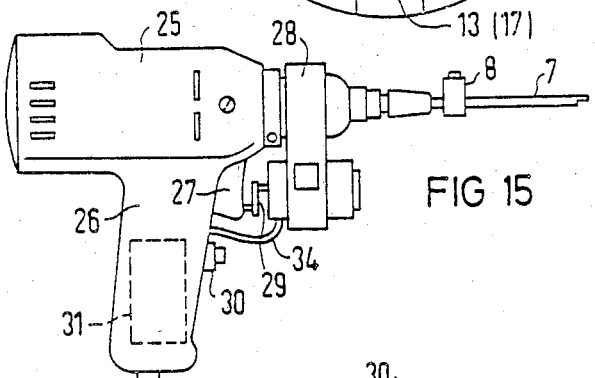
FIG. 15 is an elevational view of a wrapping tool.

FIG. 15 shows an example for this. The commercially available wrapping tool 25 intended for driving the wrapping insert consists substantially of a motor, a gun-like handle 26 and a pushbutton switch 27. According to a further embodiment of the invention, the switch 27 is no longer operated by hand for the purpose of ensuring a constant and, in particular, minimum number of turns, but by an electromagnet 28 which is flanged to the housing of the tool and the armature of which actuates the pushbutton switch 27 via a linkage 29 for a defined time, this time being determined by a timing relay or a time delay stage which is triggered by means of a manually operable key 30.

Figure 16:
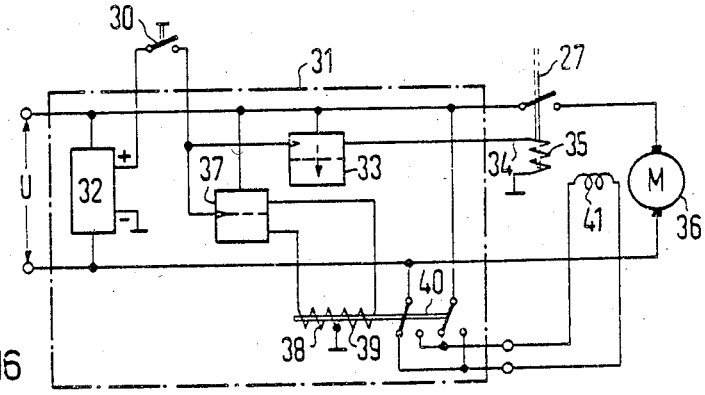
FIG. 16 is an electric circuit diagram of the circuit contained in the pistol-handle of the wrapping tool of FIG. 15 for addressing an electromagnet therein.

FIG. 16 shows an example of an electric circuit which is suitable for addressing the electromagnet 28 and can be integrated, as indicated in FIG. 15, in the pistol handle 26 as a functional block 31. This addressing circuit contains a power supply 32 connected to the line voltage U, which generates a constant d-c control voltage P. By means of the key 30, a monostable multivibrator 33 is triggered which delivers after every trigger pulse, i.e, after every closure of the key 30, a pulse at its output, which lasts for the duration of a period determined by its relaxation time T and actuates via the line 34 the armature 35 and thereby, the switch 27. The latter connects the armature of the drive motor 36 to the line voltage U and at the same time couples, after a latch is removed, the shaft of the motor 36 to the wrapping insert, which, however, is not shown in detail. At the end of the constant relaxation time T, the magnet is de-energized, the motor is switched off and the clutch disengaged.

The circuit according to FIG. 16 contains a further practical embodiment which prevents a swirling motion of the wire in a simple manner if it is introduced from the rear through the wrapping tool and the wrapping insert and thereby makes the use of a supply spool which is fastened on the wrapping tool 25 and requires a separate operation for winding it up, unnecessary. Its basic idea consists in that the wrapped joint is made alternatingly by clockwise and counterclockwise rotation. To this end, a bistable multivibrator 37 is provided, the dynamic input of which is likewise addressed with d-c voltage by the key 30. The two outputs of the bistable multivibrator 37 are antivalent and carry either a signal which corresponds to the d-c voltage P or zero or ground potential. Thus, if the one output has zero signal, a voltage appears at the other output, by which a coil 38 or 39, respectively, connected to this output is energized, whereby the armature common to both coils brings the reversing switch 40 into its one or other position. With every pulse arriving at the input of the bistable multivibrator 37, i.e., for every operation of the key 30, the bistable multivibrator is therefore brought from the one into the other position, whereby the reversing switch 40 is actuated and the polarity of the field winding 41 of the motor is reversed each time. Thereby, the drive motor changes its direction of rotation with every operation of the key 30.

We claim:

1. Device for performing a method of forming an electrically conductive wire-wrap connection between a wire and a metallic pin, having a stationary guide sleeve with a rotating wrapping insert received therein for guiding a wire to be wrapped in a continuous elongated channel, and formed with a central bore-hole wherein a pin is received, comprising an end face formed on the wrapping insert and facing the pin, said end face being formed with a transverse slot wherein the elongated channel terminates, and which widens at least section wise towards the bottom of said transverse slot, said transverse slot having a depth greater than the diameter of the wire.

2. Device according to claim 1 wherein said transverse slot has defining sides formed in part of a conical borehole.

3. Device according to claim 1 including an adapter mounted on said guiding sleeve, a radially displaceable knife mounted in said guiding sleeve, said knife being movable against spring bias into an annular groove formed on said wrapping insert for severing the wire.

4. Device according to claim 3 wherein said knife has opposite cutting edges, respectively, for corresponding opposite directions of rotation of said wrapping insert.

5. Device according to claim 1 wherein said guide sleeve having an end facing towards the pin and formed with a fingershaped projection with a guide channel formed therein for fixing a starting end of the wrapping therein.

6. Device according to claim 1, wherein the wrapping insert is connectible to an electric motor via a disengageable, detentable clutch, comprising an electromagnetic actuating element, and a key-triggered timer for exciting said actuating element so as to effect a time-defined engagement of said clutch.

7. Device according to claim 1 wherein said wrapping insert is formed with another elongated channel terminating in the bottom of said transverse slot for receiving a wire insertable therein at said end face of the wrapping insert, said wire insertable into said other elongated channel terminating, in disengaged condition of the clutch, at a severing window formed in said guide sleeve.

8. Device according to claim 6, including a reversing switch for a field current of the electric motor, said switch being operatively connected to said timer.

9. Device according to claim 6, including a reversing switch for a motor current of the electric motor, said switch being operatively connected to said timer.

10. Method of producing an electrically conducting wrapped-joint between a wire and a metallic pin which comprises inserting a wire into a continuous generally longitudinally extending channel formed in a rotatable wrapping insert of a wrapping tool; inserting a metallic pin into an end of the rotatable wrapping insert so that the wire is radially spaced from a wrapping surface formed on the rotatable wrapping insert and defines, with the metallic pin, a gap which narrows in a direction towards the end of the wire which is to be wrapped and which is an extension of the generally longitudinally extending channel; further extending the wire into the narrowing gap; and rotating the wrapping insert so that the wrapping surface engages the wire to form turns which are squeezed through the gap and rolled tightly against the pin as a wrapping, the wrapping surface of the insert transferring radial forces to the outer periphery of the wrapping.

11. Method according to claim 10 wherein another wrapping surface is formed on the wrapping insert diametrically opposite the first-mentioned wrapping surface and likewise defining a narrowing gap with the pin; and wherein rotating the wrapping insert brings both of the wrapping surfaces into engagement with the wire to form the turns, squeeze them through the respective gaps, and roll them tightly against the pin.

* * * * *

UNITED STATES PATENT AND TRADEMARK OFFICE

CERTIFICATE OF CORRECTION

PATENT NO. : 4,603,457

DATED : August 5, 1986

INVENTOR(S) : ERNST F. LECHNER and PETER VACHE

It is certified that error appears in the above-identified patent and that said Letters Patent are hereby corrected as shown below:

In the heading, item (30), line 13,

"Aug. 12, 1981 (DE) Fed. Rep. of Germany ..... 31319549"

should read

--Aug. 12, 1981 (DE) Fed. Rep. of Germany ..... 3131945--.

Signed and Sealed this

Twenty-fourth Day of February, 1987

*Attest:*

DONALD J. QUIGG

*Attesting Officer*

*Commissioner of Patents and Trademarks*